United States Patent [19]

Nakajima

[11] 4,099,662

[45] Jul. 11, 1978

[54] METHOD AND APPARATUS FOR PRODUCING WELDED STEEL TUBES HAVING LARGE SQUARE CROSS SECTION

[75] Inventor: Hiromu Nakajima, Itami, Japan

[73] Assignee: Kabushiki-Kaisha Nakajima, Osaka, Japan

[21] Appl. No.: 750,779

[22] Filed: Dec. 15, 1976

[30] Foreign Application Priority Data

| | | | |
|---|---|---|---|
| Dec. 20, 1975 | [JP] | Japan | 50-152105 |
| Feb. 9, 1976 | [JP] | Japan | 51-13505 |
| Feb. 9, 1976 | [JP] | Japan | 51-13506 |
| Feb. 9, 1976 | [JP] | Japan | 51-13507 |
| Feb. 9, 1976 | [JP] | Japan | 51-13508 |

[51] Int. Cl.[2] ..... B23K 31/02

[52] U.S. Cl. ..... 228/151; 228/17.5

[58] Field of Search ..... 228/150, 151, 17.5, 228/175

[56] References Cited

U.S. PATENT DOCUMENTS

| | | | |
|---|---|---|---|
| 1,229,774 | 6/1917 | Moon | 228/151 |
| 2,127,618 | 8/1938 | Riemenschneider | 228/151 |
| 2,746,141 | 5/1956 | Hobrock | 228/151 |
| 2,976,611 | 3/1961 | Giffen | 228/151 |
| 3,075,484 | 1/1963 | Benteler | 228/151 X |
| 3,452,425 | 7/1969 | Gartner | 228/151 X |
| 3,524,245 | 8/1970 | Searling | 228/151 X |

*Primary Examiner*—Donald G. Kelly

*Attorney, Agent, or Firm*—Frank J. Jordan

[57] ABSTRACT

A method of producing a welded square steel tube from a single steel plate by preparing the opposite side edges of the plate for welding, bending the plate at the portions corresponding to the four corners of the square tube, fitting together the opposed edges of the bent plate, subjecting the edges to tack welding, welding together the opposed edges from inside and outside the tubular bent plate and straightening the resulting tube. These steps are conducted in succession while the steel plate is being conveyed in its longitudinal direction. An apparatus for practicing this method is also disclosed.

10 Claims, 7 Drawing Figures

METHOD AND APPARATUS FOR PRODUCING WELDED STEEL TUBES HAVING LARGE SQUARE CROSS SECTION

This invention relates to a method and an apparatus for producing novel welded steel tubes having a large square cross section, and more particularly to a method and an apparatus for producing such a welded steel tube from a single steel plate by carrying out edge preparation, bending and welding operations in succession while the plate is being conveyed longitudinally thereof.

Steel tubes of large square cross section for civil engineering and other uses are usually prepared by bending two steel plates to a U-shaped cross section and joining the plates together by butt welding along the opposed edges as they are arranged face to face. Since the steel tube obtained has two weld lines, the welding material and welding operation predominantly account for the cost of the steel tube and the welding operation results in the need for a straightening operation. These are the principal difficulties encountered in reducing the manufacturing cost of steel tubes of the type described. Although steel tubes of small cross section have been produced by bending a steel plate and welding the opposed edges thereof along a single weld line, it has been considered impractical to produce steel tubes of 350 mm × 350 mm or large cross section from a single plate because of the many problems involved in bending and in other operational steps. Furthermore, because the conventional method includes many steps such as edge preparation, bending of the two steel plates, fitting of the two plates in opposed arrangement, tack welding, final welding, and straightening, it has been difficult to conduct the overall operation in a continuous manner. Consequently, the transfer of the materials from one step to another requires considerable labor and renders the product costly.

Accordingly, an object of this invention is to provide a method for producing a steel tube of large square cross section from a single steel plate.

Another object of this invention is produce such a steel tube from a single steel plate by a continuous operation.

Another object of this invention is to provide a method of producing a steel tube from a single steel plate which reduces the welding operation and the amount of welding material required.

Another object of this invention is to carry out the edge preparation, bending and welding operation for a steel plate in successive steps while the plate is being conveyed by feed rolls in its longitudinal direction so that the material can be transferred smoothly from one step to another.

Another object of this invention is to render the operation continuous by carrying out tack welding while the opposed edges of a bent steel plate are being fitted together.

Still another object of this invention is to provide an apparatus for practicing the foregoing method.

Other objects and features of this invention will become more apparent from the following detailed description with reference to the accompanying drawings, in which.

Figure 1:
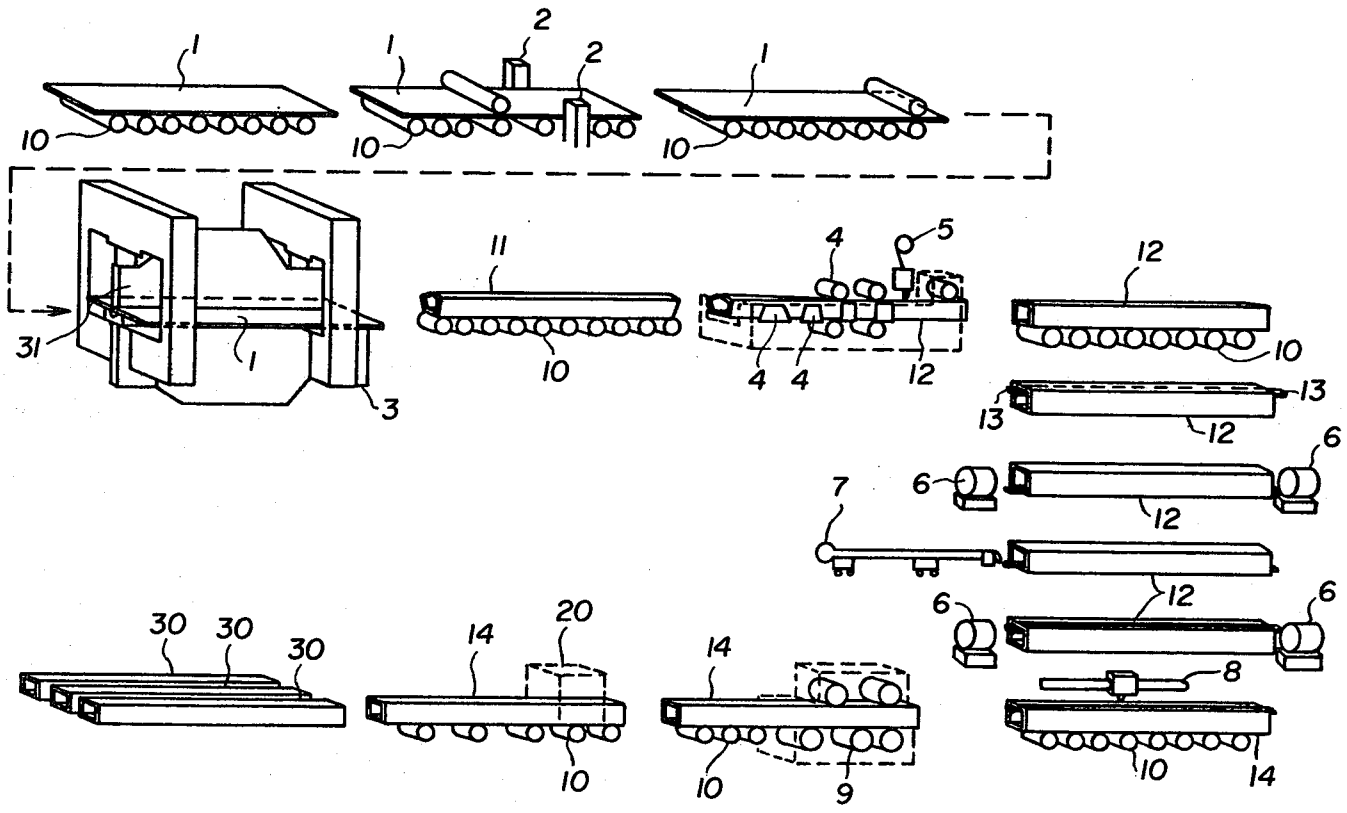
FIG. 1 is a flow diagram illustrating the method of this invention.
Figure 2:
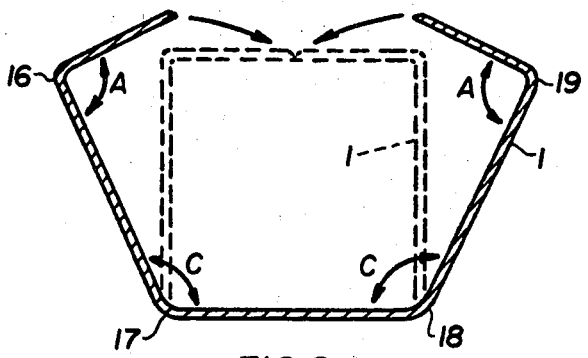
FIG. 2 is a cross sectional view showing how a steel plate is bent into a semi-finished steel tube.
Figure 3:
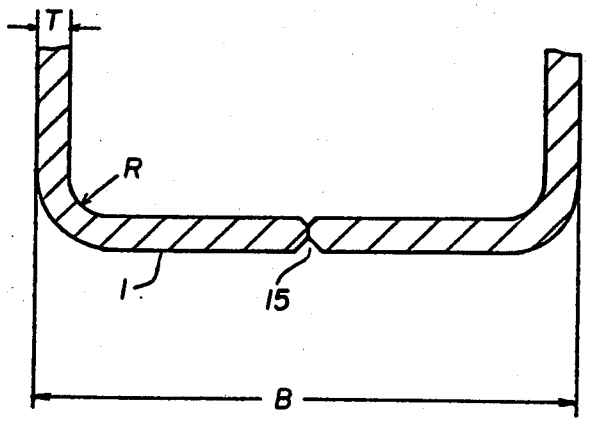
FIG. 3 is a cross sectional view of the steel tube showing the joint geometry thereof.

With reference to FIG. 1, a flat steel plate 1 of predetermined dimensions is advanced from a feeder (not shown) and is fed in the position shown to edge preparation means 2 by feed rollers 10 and pinch rolls on the opposite sides. The opposite side edges are prepared for welding by such edge preparation means 2. The steel plate 1 is then fed by the feed rollers 10 to a shaping press 3, in which the portions of the plate 1 to be formed into the corners of a steel tube of square cross section are bent by a plate-like presser 31 adapted to act thereon over the entire length thereof at the same time. In this shaping step, a corner portion 16 of the steel plate 1 (see FIGS. 2 and 4) is first bent to a predetermined angle. Subsequently, the bending operation is repeated at a corner portion 17 on the same side of the longitudinal center line of the plate, then at a corner portion 19 and finally at a corner portion 18 (see FIGS. 2 and 4). Preferably, the steel plate 1 is bent to such extent that the corners 16 and 19 have an angle A of approximately 92° and the corners 17 and 18, an angle C of approximately 115°. When thus shaped, the steel plate 1 assumes the cross sectional shape shown in solid line in FIGS. 2 and 4 resembling a steel tube of square cross section. The thus work 11 (see FIG. 1) is withdrawn from the shaping press 3 by the feed rollers 10 and is advanced to shaping means such as rolls 4, in which the work is so pressed by oppositely disposed side rollers that the opposed edges of the work are progressively brought towards and into alignment with each other while the work is also pressed by rollers from above and below. When the opposed edges of the work 11 have been brought into abutting contact with each other, with the corners 17 and 18 given an angle of 90°, the shaped work 11 is subjected to tack welding by a welding machine 5 and thereby formed into a semi-finished product 12 in the form of a steel tube of specified square cross section.

As already stated, the corner portions are bent by the shaping press 3 so that the angle A will be approximately 92° and the angle C is approximately 115° irrespective of the size of the steel tube to be formed. The radius of curvature, R, for various thicknesses T, is shown in Table 1.

Table 1

| Thickness T of steel plate (mm) | R (mm) | Dimension B of steel tube (mm) |
|---|---|---|
| 9 | 24 | |
| 12 | 24 | |
| 16 | 45 | |
| 19 | 45 | 350 – 600 |
| 22 | 75 | |
| 25 | 75 | |

Figure 6:
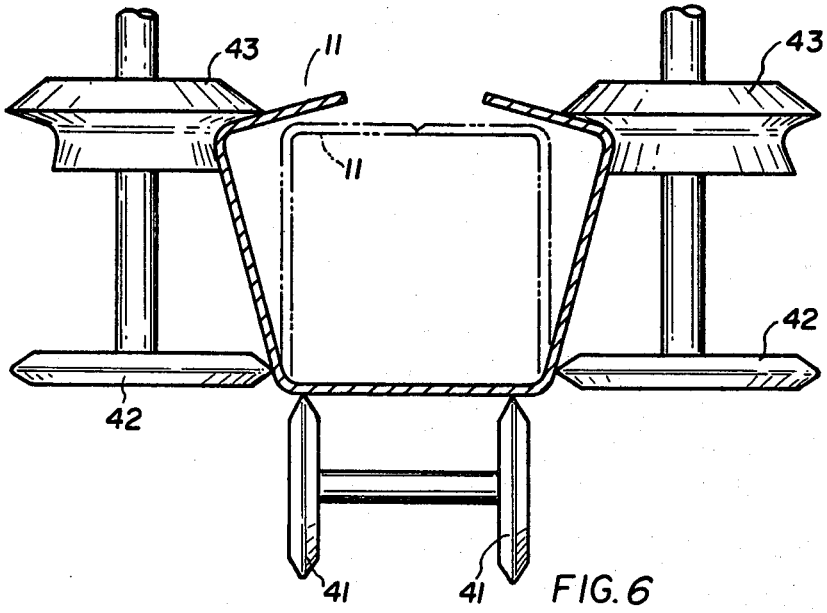

Alternatively, the shaping roll means 4 may have the construction shown in FIG. 6. In this case, the shaping roll means 4 comprises lower rollers 41, 41 and coaxially rotatable rollers 42, 43 on each of the opposite sides. The lower rollers 41, 41 rollably support the work 11 whereas the respective side rollers 42, 43 press the shaped work 11 so as to cause the opposed free edges thereof to approach each other while the work 11 is advanced longitudinally. The rollers 41 and 42 are in contact with the shaped work 11 adjacent the curved lower corner portions. The rollers 43 are so shaped as to engage closely with the outer surface of the upper corner portions. A plurality of sets of such rollers are arranged longitudinally of the shaped work 11. The lateral distance between each pair of the rollers 43, 43 decreases in the longitudinal direction in which the shaping operation progresses, such that at the final stage of the operation, the rollers 43, 43 engage with the opposite shoulders of the shaped work and thus maintain the opposed free edges thereof in abutting contact with each other. Thus, the shaping roll means shape the work 11 to the desired form while in transit.

Figure 5:
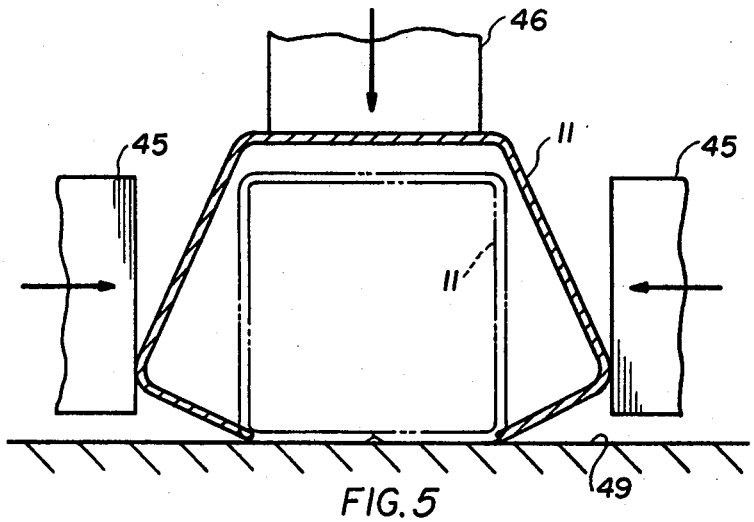
FIGS. 5 and 6 are cross sectional views showing how the edges of a bent steel plate are fitted together.

In place of the shaping roll means 4, it is possible to employ a press as shown in FIG. 5. The press comprises a pair of opposed horizontal presses 45, 45 and a vertical press 46. The shaped work 11 is fed onto a support frame 49 and in an inverted position is thereafter engaged by the presses 45, 45 on its opposite sides while being also pressed by the press 46 from above, whereby the work is shaped to the desired form of square steel tube. The free edges are joined together by tack welding. In order to shape the work accurately to the specified form, a die may be inserted into the work.

The shaping roll means and the alternate press means are adapted to be adjustable at least to the ranges of dimensions listed in Table 1 for the production of square steel tubes of varying sizes.

Figure 4:
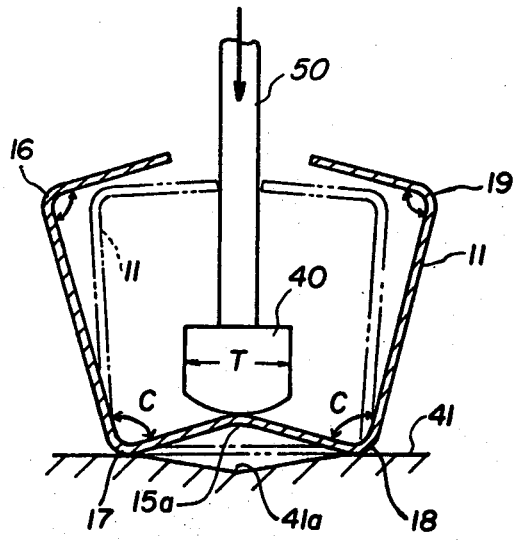
FIG. 4 is a cross sectional view showing another mode of bending a steel plate.

The bending operation may alternatively be conducted by press means in the manner illustrated in FIG. 4. The flat steel plate 1 is first bent at a center portion 15*a*, and the corner portions 16, 17 and 19 are thereafter bent in the opposite direction. Finally the corner portion 18 is in the same direction as that of the other corners. The steel plate 1 is bent to such extent that the corner portions 16 and 19 have an angle A of about 92° and corners 17 and 18 have an angle C of about 90°, whereby the plate 1 is shaped to approximately resemble a steel tube of square cross section as shown by solid line in FIG. 4. The distance between the opposed edges of be joined together is such that it permits the passage of a ram 40 therethrough. Thus, it is slightly greater than the width T (usually 100 to 150 mm) of the ram 40. When the steel plate 1 has been thus shaped it is placed on a support frame 41 having a predetermined recess 41*a* therein having a configuration opposite to that of the center portion 15*a* of the plate. The center portion 15*a* is then pressed by ram 40 toward the recess 41*a*, utilizing the resiliency of the steel plate. This brings the opposed free edges of the plate toward each other almost into contact with the holder 50 of the ram 40. The ram 40 is withdrawn from the shaped work 11 by moving the work 11 longitudinally thereof, or by moving the ram 40 in the longitudinal direction of the shaped work 11. The shaped work 11 is then advanced to the next step in the process, in which the free edges of the work 11 are urged into abutting contact with each other by the rolls 4. This step is followed by tack welding with use of the welding machine 5. Since the edges before being brought into abutment with each other are spaced apart by a distance nearly equal to the width (usually 20 to 25 mm) of the holder 50, such edges can be easily brought into abutting contact with each other by the rolls 4.

Figure 7:
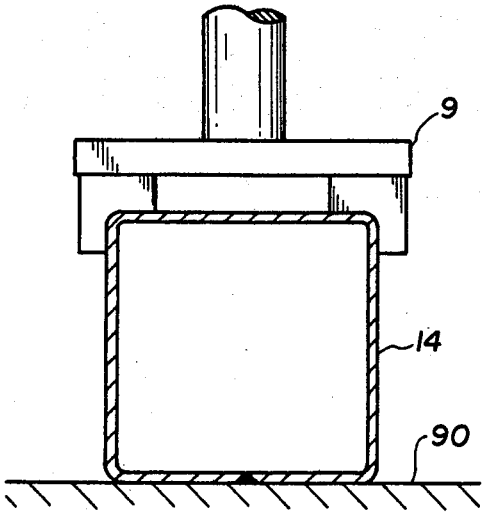
FIG. 7 is a cross sectional view illustrating the step of straightening the welded tube.

End tabs 13, 13 for submerged arc welding are then attached to the opposite ends of the abutting edge portions of the semi-finished product 12 resulting from the tack welding. The work 12 is inverted by reversing means 6 and is transferred onto a welding table, on which the longitudinally extending groove is welded from inside by an automatic welding machine 7. The work 12 is thereafter again reversed, and the longitudinal groove is welded from outside to obtain a steel tube 14 of square cross section. The tube 14 is then advanced by feed rollers to the next step in the process, in which it is straightened by being passed between rollers 9. Since the welding operation usually produces a curve in the steel tube 14 longitudinally thereof, a plurality of correcting rollers 9 are arranged in the longitudinal direction, with intermediate rollers adapted to be movable up and down to remove the longitudinal strain. Alternatively, a plurality of presses 9 are arranged in the longitudinal direction which are adapted to bear against the opposite shoulders of the square steel tube 14 as seen in FIG. 7. The presses bear upon the square steel tube 14 while the tube is being moved on a support frame 90 to eliminate the strain in the longitudinal direction.

The straightened steel tube 14 is thereafter fed by feed rollers 10 to detecting means 20, such as a supersonic crack detector, by means of which the weld zone is examined to obtain a finished product.

The foregoing operational steps, starting with the feeding of the planar steel plate and ending with the withdrawal of the finished product, may be carried out by movement along a single line or, alternatively, the welding of the groove from inside the semifinished product and the following steps which take a relatively long period of time may be conducted along a second line in parallel to a first line adapted to carry out the preceding steps.

According to the present invention described above, a steel tube of square cross section having only one weld line is produced from a single steel plate by a continuous process. The invention, therefore, has various advantages as will be described below. The invention reduces the amount of welding material consumed, and reduces the and edge preparation procedure to one half the amounts required in the conventional procedures resulting in a steel tube having two weld lines. Furthermore, the reduction in the weld zone reduces the strain produced and therefore reduces the amount of straightening operation. Due to the reduced weld line, the overlapping of the weld zone can be avoided with greater ease when the steel tube is welded to some other member. Since the overall operation is carried out continuously, the work can be transferred smoothly from one step to another, while irregularies to be otherwise involved in the operation can be eliminated. This serves to reduce the labor required and ensures efficient mass production. Because of these advantages, the invention greatly reduces the manufacturing cost of steel tubes and is of immense value for industrial operation.

What is claimed is:

1. A method of producing a welded steel tube of relatively large square cross section comprising:

advancing a single steel plate of at least substantially 9mm thickness longitudinally thereof while preparing the opposed longitudinal edges of same for welding;

bending swquentially a first longitudinally extending portion of the steel plate adjacent one free edge thereof and then a second longitudinally extending portion of the plate to be bent into the next adjacent corner portion, then bending a third longitudinally extending portion of the plate adjacent the other free edge thereof and finally a fourth longitudinally extending portion of the plate intermediate said second and fourth portions corresponding to the four corners of the square steel tube to be produced to thereby shape the plate to a form approximate to the desired square steel tube having opposed free edges extending longitudinally of the plate;

subjecting the thus shaped plate to further shaping and to tack welding along said free edges to the form of the square steel tube while continuing to advance the plate longitudinally;

welding the opposed free edges of the thus formed square steel tube from inside and outside the tube by automatic welding means;

and straightening the welded tube while the tube is further advanced.

2. A method according to claim 1, wherein the plate is subjected to said tack welding while the side walls thereof are being simultaneously pressed inwardly such that the said free edges are urged toward each other into abutting relation for the tack welding and, at the same time, pressure is applied to the closed side of the plate.

3. A method according to claim 2, wherein said plate is inverted and further shaped before being subjected to said tack welding.

4. A method according to claim 1, wherein the opposed free edges of said plate are progressively brought toward each other by roll means adapted to engage with shoulders of the tube on the opposite sides of said free edges.

5. A method according to claim 1, wherein the welded tube is straightened by being advanced longitudinally while being engaged by press means adapted to hold opposite shoulders of the tube.

6. Apparatus for producing a welded steel tube of relatively large square cross section comprising:

conveying means for advancing a flat steel plate having a minimum thickness of substantially 9mm longitudinally thereof;

means for preparing the opposed longitudinal large square cross section comprising:

conveying means for advancing a flat steel plate longitudinally thereof;

means for preparing the opposed longitudinal edges of the plate for welding, means for bending the steel plate approximately to the shape of the square steel tube to be produced in which opposed free edges of the plate extend longitudinally and in spaced relation;

means for further shaping the bent plate to the square steel tube and for bringing said free edges into abutting relation;

tack welding means for tack welding said tube longitudinally along said free edges;

automatic welding means for welding the opposed free edges of the bent steel plate from inside and from outside the tube;

and means for straightening the square tube after welding;

said conveying means being adapted to advance the steel plate sequentially and continuously from said edge - preparing means to said straightening means.

7. Apparatus according to claim 6, wherein said means for further shaping the steel plate comprises a series of rollers disposed on each of the opposite sides of the tube adapted to progressively bring the free edges thereof into alignment and abutting relationship and rollers positioned above and below the tube.

8. Apparatus according to claim 7, wherein each said series of side rollers includes an upper roller configured to engage closely with the outer surface of the upper corner portions of the tube, the lateral distance between corresponding ones of each of said series of rollers decreasing in the direction of longitudinal advancement of the tube.

9. Apparatus according to claim 6, wherein said means for further shaping the steel plate comprises a pair of opposed horizontal presses adapted to apply lateral pressure on the opposed sides of the tube and a vertical press member adapted to apply pressure to the upwardly facing surface of the tube.

10. A method of producing a welded steel tube of relatively large square cross section comprising:

advancing a single steel plate longitudinally thereof while preparing the opposed longitudinal edges of same for welding;

bending the central portion of the plate in a first direction;

bending longitudinally extending portions of the plate along regions corresponding to the four corners of the square steel tube to be produced in a second direction opposite to that of said central portion and through an angle of about 90° to thereby shape the plate to a form approximate to the desired square steel tube having opposed free edges extending longitudinally of the plate;

thereafter applying pressure to the inner surface of the closed side of the tube over the entire length thereof to straighten the bent central portion therein and to thereby urge said free edges toward each other;

subjecting the thus shaped plate to further shaping and to tack welding along said free edges to the form of the square steel tube while continuing to advance the plate longitudinally;

welding the opposed free edges of the thus formed square steel tube from inside and outside the tube by automatic welding means;

and straightening the welded tube while the tube is further advanced.

* * * * *